US007654303B2

(12) United States Patent
Hirata et al.

(10) Patent No.: US 7,654,303 B2
(45) **Date of Patent: *Feb. 2, 2010**

(54) METHOD AND APPARATUS FOR MOLDING AN UPPER AND A LOWER MOLD HAVING NO FLASK

(75) Inventors: Minoru Hirata, Toyokawa (JP); Takayuki Komiyama, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 408 days.

This patent is subject to a terminal disclaimer.

(21) Appl. No.: 10/591,166

(22) PCT Filed: Dec. 17, 2004

(86) PCT No.: PCT/JP2004/018897

§ 371 (c)(1),
(2), (4) Date: Aug. 30, 2006

(87) PCT Pub. No.: WO2005/089983

PCT Pub. Date: Sep. 29, 2005

(65) Prior Publication Data

US 2007/0175607 A1 Aug. 2, 2007

(30) Foreign Application Priority Data

| | | |
|---|---|---|
| Mar. 18, 2004 | (JP) | 2004-077333 |
| Apr. 21, 2004 | (JP) | 2004-125536 |
| Nov. 17, 2004 | (JP) | 2004-332788 |

(51) Int. Cl.

| | |
|---|---|
| ***B22C 9/00*** | (2006.01) |
| ***B22C 15/02*** | (2006.01) |
| ***B22C 15/24*** | (2006.01) |

(52) U.S. Cl. ..... 164/20; 164/29; 164/184; 164/194; 164/201

(58) Field of Classification Search ..... 164/18–22, 164/180–184, 194, 200–202, 214, 322, 29
See application file for complete search history.

(56) References Cited

U.S. PATENT DOCUMENTS

| | | | | |
|---|---|---|---|---|
| 3,589,432 | A | 6/1971 | Miller et al. | |
| 4,463,794 | A | 8/1984 | Shioda | |
| 4,541,476 | A * | 9/1985 | Larsen | 164/182 |
| 4,791,974 | A | 12/1988 | Larsen | |
| 5,246,058 | A * | 9/1993 | Murata | 164/182 |
| 6,470,953 | B1 * | 10/2002 | Hirata et al. | 164/37 |

FOREIGN PATENT DOCUMENTS

| | | |
|---|---|---|
| DE | 33 12 539 C1 | 3/1984 |
| EP | 0 468 355 A2 | 1/1992 |
| EP | 1 208 928 A1 | 5/2002 |
| JP | 62-16736 | 4/1987 |
| JP | 3-243243 | 10/1991 |
| WO | WO 00/50187 A | 8/2000 |

OTHER PUBLICATIONS

Office Action dated Feb. 27, 2009 in U.S. Appl. No. 10/582,965.

* cited by examiner

*Primary Examiner*—Kuang Lin
(74) *Attorney, Agent, or Firm*—Finnegan, Henderson, Farabow, Garrett & Dunner, L.L.P.

(57) ABSTRACT

A method and apparatus for molding molds having no flask wherein a match plate having a pattern is put between a pair of an upper and a lower flask having intakes for foundry sand. An upper and a lower molding space are defined by inserting an upper and a lower squeeze device into openings of the pair of the upper and the lower flask having no match plate, and the pair of the upper and the lower flask and the match plate are rotated and moved so that they become perpendicular and then the intakes of the flasks move upward. The upper and the lower molding space are then filled with the foundry sand. The foundry sand in the molding space is squeezed by the squeezing device. The pair of the flasks and the match plate are rotated so that they become horizontal. Then the match plate is removed, the flasks are matched to each other, and the molds are removed from the pair of flasks.

14 Claims, 12 Drawing Sheets

(a)

(b)

METHOD AND APPARATUS FOR MOLDING AN UPPER AND A LOWER MOLD HAVING NO FLASK

TECHNICAL FIELD

These inventions relate to a method and apparatus for molding an upper and a lower mold having no flask.

BACKGROUND OF THE INVENTIONS

Conventionally, as one of the molding machines of this type, there is the following apparatus, comprising:

a first station, which is disposed above a base, for compressing foundry sand in a molding space by squeezing the sand in a horizontal direction, a second station, which is disposed near a lower surface of the base, for matching an upper mold with a lower mold in a perpendicular direction against the lower surface of the base and for removing flasks, wherein two sets of the upper and the lower flask are alternately reciprocated between the first and the second station, and wherein an upper and a lower mold that match each other and that have no flask are molded.

However, the conventional molding machine for molding an upper and a lower mold having no flask has problems to be solved, such as it is not efficient enough, and it is necessary to improve the quality of the mold.

Patent document 1: Examined Japanese Patent Application Publication No. S62-16736

DISCLOSURES OF INVENTIONS

These inventions intend to provide an improved method and apparatus for molding an upper and a lower mold that match each other and that have no flask, and which can solve the problems of the conventional apparatus, such as the conventional apparatus not being efficient enough, it being necessary to improve the quality of the mold.

The first invention is constituted of the following elements to solve these problems.

A method for molding an upper and a lower mold that match each other and that have no flask, comprising:

a process to put a match plate that is between an upper and a lower flask having an intake for foundry sand and to hold the match plate, wherein the match plate and the upper and the lower flask are horizontal, a process to define an upper and a lower molding space by inserting an upper and a lower squeeze means into openings of a pair of the upper and the lower flask having no match plate, a process to rotate the pair of the upper and the lower flask and the match plate so that they are perpendicularly positioned, and to move them so that the intakes of the upper and the lower flask move upward, a process to fill the upper and the lower molding space with the foundry sand through the intakes of the upper and the lower flask, a process to squeeze the foundry sand of the upper and the lower molding space by causing the upper and the lower squeeze means to further approach each other, a process to rotate the upper and the lower flask and the match plate so that they are horizontally positioned, and a process to remove the match plate disposed between the upper and the lower flask after separating the upper and the lower flask containing a mold from the match plate, a process to match the upper and the lower flask containing the mold after the core is installed between the upper and the lower mold, if necessary, and a removing process to remove the molds from the upper and the lower flask that match each other.

According to this invention, it is possible to make an upper and a lower mold having no flask faster and more efficiently compared with the conventional method.

The second invention is constituted by the following elements to solve the problems.

The method of the first invention, wherein the process to define the upper and the lower molding space by inserting the upper and the lower squeeze means into the openings of a pair of the upper and the lower flask having no match plate, and the process to rotate a pair of the upper and the lower flask and the match plate so that they are perpendicularly positioned, and to move them so that the intakes of the upper and the lower flask move upward, simultaneously proceed.

According to this invention, it is possible to improve the productivity of the molds.

The third invention is constituted of the following elements to solve the problems.

The method of the first invention, wherein the process to squeeze the foundry sand of the upper and the lower molding space by causing the upper and the lower squeeze means to further approach each other, and the process to rotate a pair of the upper and the lower flask and the match plate so that they are horizontally positioned, proceed simultaneously.

According to this invention, it is also possible to improve the productivity of the molds.

The fourth invention is constituted of the following elements to solve the problems.

The method of the first invention, wherein the upper and the lower squeeze plate are provided as the upper and the lower squeeze means.

According to this invention, a simpler method for molding the molds can be provided by using the apparatus for molding the upper and the lower mold having no flask.

The fifth invention is constituted of the following elements to solve the problems.

The method of the first invention, wherein the upper and lower segmented-squeeze feet are provided as the upper and the lower squeeze means.

According to this invention, an upper and a lower mold that are more uniform, and that have a high quality, and foundry sand having a high density, can be molded.

The sixth invention is constituted of the following elements to solve the problems.

The method of the fourth invention, further comprising a process to move further apart the upper squeeze plate from the lower squeeze plate to a predetermined distance, and the process to fill the upper and the lower molding space with the additional foundry sand through the intakes of the upper and the lower flask, after the process to fill the molding space with the sand through the intakes is completed.

According to this invention, further, an upper and a lower mold that are more uniform, and that have a high quality, and foundry sand having a high density, can be molded.

The seventh invention is constituted of the following elements to solve the problems.

The method of the sixth invention, wherein the process to move further apart the upper squeeze plate from the lower squeeze plate to a predetermined distance, and the process to fill the upper and the lower molding space with the additional foundry sand through the intakes of the upper and the lower flask, proceed simultaneously.

According to this invention, further, an upper and a lower mold that are more uniform, and that have a high quality, and foundry sand having a high density, can be molded.

The eighth invention is constituted of the following elements to solve the problems.

The method of the fifth invention, wherein the process to define the upper and the lower molding space by inserting the upper and the lower squeeze means into openings of a pair of the upper and the lower flask having no match plate further includes a setting process to set the distance between the pattern of the match plate and each of a plurality of the upper and lower segmented-squeeze feet so that each of the ratios between the distance after squeezing and that before squeezing becomes the same.

According to this invention, further, upper and lower molds that are more uniform, and that have a high quality, and foundry sand having a high density, can be molded.

The ninth invention is constituted of the following elements to solve the above problems.

The method of the fifth invention, wherein the process to define the upper and the lower molding space by inserting the upper and the lower squeeze means into openings of a pair of the upper and the lower flask having no match plate further includes a forming process to form the molding space defined by the pattern of the match plate and each of a plurality of the upper and lower segmented-squeeze feet so that the foundry sand can easily flow in the molding space.

According to this invention, further, an upper and a lower mold that are more uniform, and that have a high quality, and foundry sand having a high density, can be molded.

The tenth invention is constituted of the following elements to solve the problems.

The method of the ninth invention, wherein the process to form the molding space defined by the pattern of the match plate and each of a plurality of the upper and lower segmented-squeeze feet so that the foundry sand can easily flow in the molding space further includes a process to reduce the friction between the foundry sand and a wall of an aeration tank by jetting air into a nozzle (especially, a nozzle throat) of the aeration tank and the portion where it is difficult for the foundry sand to flow.

According to this invention, further, an upper and a lower mold that are more uniform, and that have a high quality, and foundry sand having a high density, can be molded.

The eleventh invention is constituted of the following elements to solve the problems.

The method of the fifth invention, wherein the process to fill the upper and the lower molding space with the foundry sand through the intakes of the upper and the lower flask and the process to squeeze the foundry sand of the upper and the lower molding space by causing the upper and the lower squeeze means to further approach each other further include:

a first filling process to fill the upper and the lower molding space defined by the upper and the lower flask, the upper and the lower squeeze means, and the match plate, which are perpendicular, with the foundry sand through the intakes of the upper and the lower flask, a first squeezing process to squeeze the foundry sand of the upper and the lower molding space by causing a plurality of the upper and lower segmented-squeeze feet of the upper and the lower squeeze means to further approach each other, a second filling process to fill the upper and the lower molding space with the additional foundry sand through the intakes of the upper and the lower flask after the retracting process to retract the upper and lower segmented-squeeze feet, and a second squeezing process to squeeze the foundry sand of the upper and the lower molding space by simultaneously causing the upper and lower segmented-squeeze feet, whose surfaces are arranged in a plane, to approach each other.

According to this invention, further, upper and lower molds that are more uniform, and that have a high quality, and foundry sand having a high density, can be molded.

The twelfth invention is constituted of the following elements to solve the above problems.

An apparatus for molding an upper and a lower mold matched to each other and having no flask, comprising:

a unit of an upper and a lower flask having an intake disposed at their side walls for foundry sand, which flasks are connected to each other by connecting rods so that they can move close to and apart from each other, a match plate disposed between the upper and the lower flask so that the match plate can be inserted in and taken out by a conveying apparatus, a squeezing mechanism to squeeze the foundry sand, which supports the unit of the upper and the lower flask having the match plate between them by a plurality of clamping mechanisms so that the unit of the upper and the lower flask can be removed, which supports an upper and a lower squeeze means inserted into openings of the upper and the lower flask having no match plate so that the squeeze means can be taken out, and which can clockwise or counterclockwise rotate in a perpendicular plane about a supporting shaft so that the pair of the upper and the lower flask having the match plate between them can become perpendicular and horizontal, a driving mechanism to clockwise or counterclockwise rotate the squeezing mechanism, and an aeration mechanism to fill the foundry sand into the upper and the lower flask, which are perpendicular, by means of the driving mechanism, through the intake.

According to this invention, it is possible to make upper and lower molds having no flask faster and more efficiently compared with the conventional apparatus.

The thirteenth invention is constituted of the following elements to solve the problems.

The apparatus of the twelfth invention, wherein the upper and the lower squeeze plate are provided as the upper and the lower squeeze means.

According to this invention, a simpler apparatus for molding an upper and a lower mold having no flask can be provided.

The fourteenth invention is constituted of the following elements to solve the problems.

The apparatus of the twelfth invention, wherein the upper and lower segmented-squeeze feet are provided as the upper and the lower squeeze means.

According to this invention, an upper and a lower mold that are more uniform, and that have a high quality, and foundry sand having a high density, can be molded.

The fifteenth invention is constituted of the following elements to solve the problems.

An apparatus of any of the 12th, 13th, and 14th inventions, wherein the clamping mechanisms to clamp the connecting rods for holding the unit of the upper and the lower flask comprise:

a pair of swinging motors, and clamp means fixed to the swinging shafts of the swinging motors.

According to this invention, it is possible to make an upper and a lower mold having no flask faster and more efficiently compared with the conventional apparatus.

BRIEF DESCRIPTIONS OF THE DRAWINGS

Figure 1:
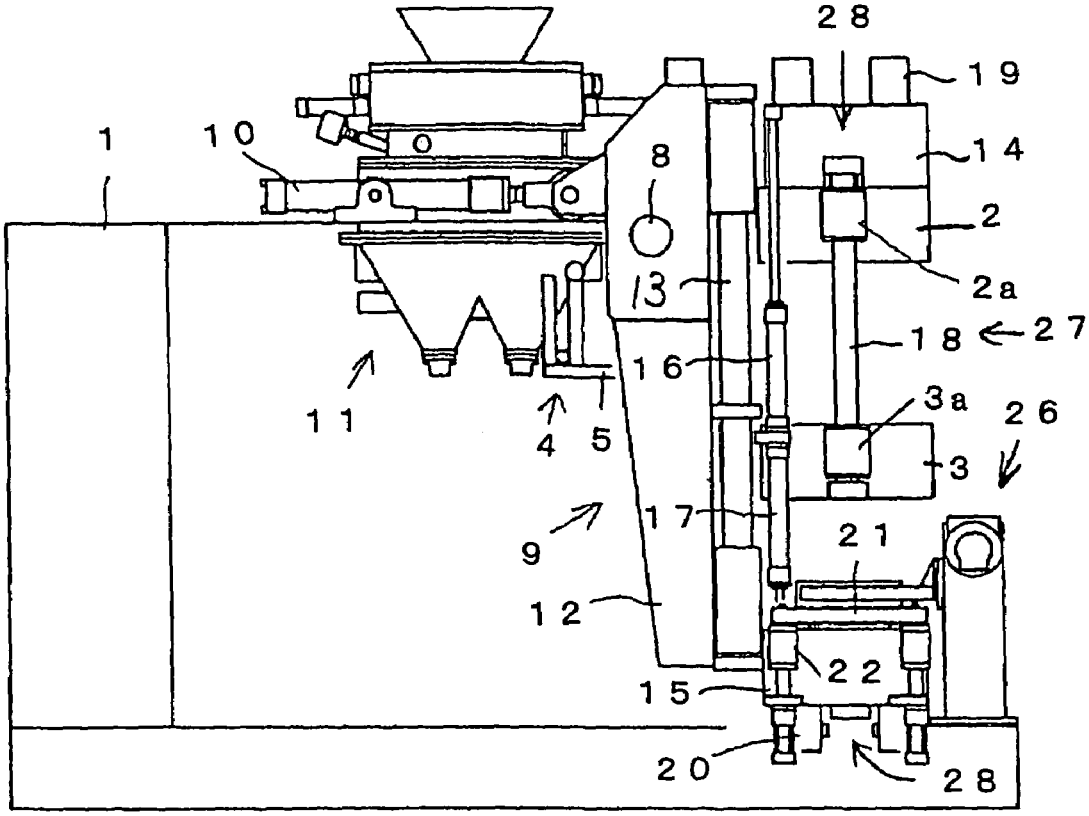
FIG. 1 shows an elevational view of an apparatus for molding a mold of the preferred embodiment of the invention, using squeeze plates as a squeeze means.
Figure 4:
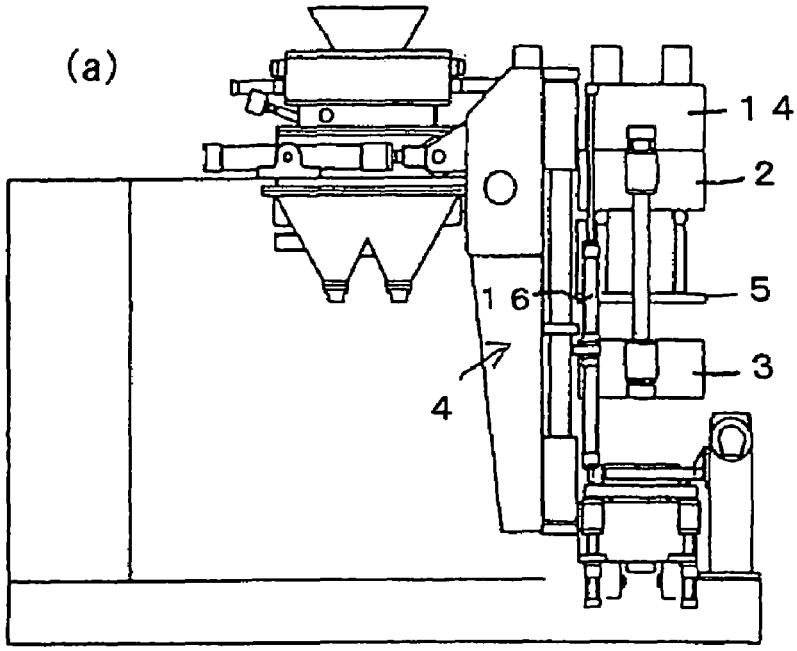
Figure 4:
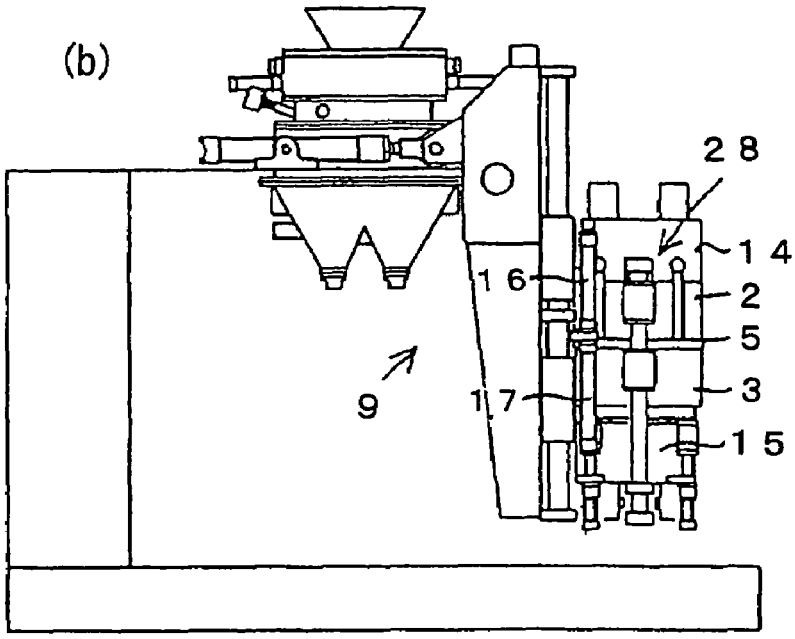

FIGS. 4(*a*) and (*b*) show operational views indicating some of the processes for molding a mold by the apparatus shown in FIG. 1.

Figure 5:
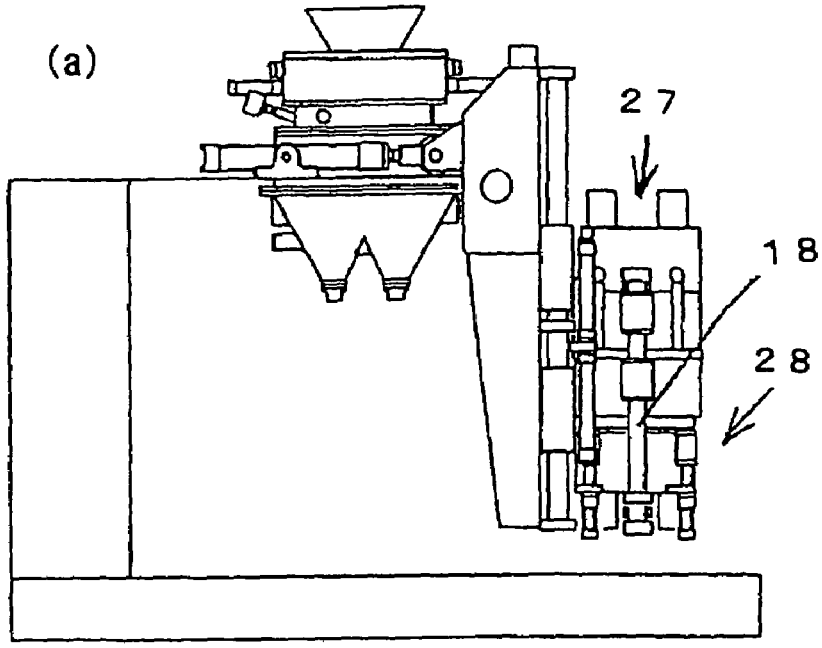
Figure 5:
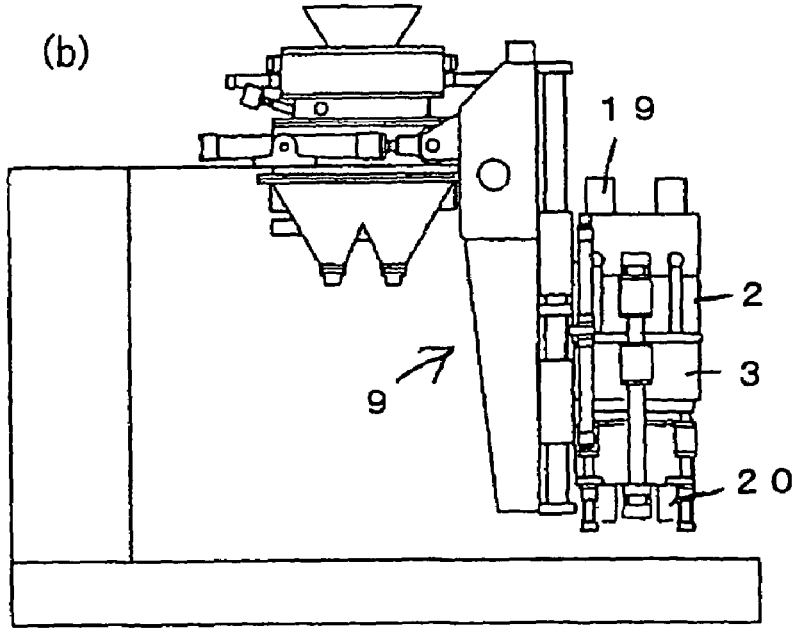

FIGS. 5(*a*) and (*b*) show operational views indicating some of the processes for molding a mold by the apparatus shown in FIG. 1.

Figure 6:
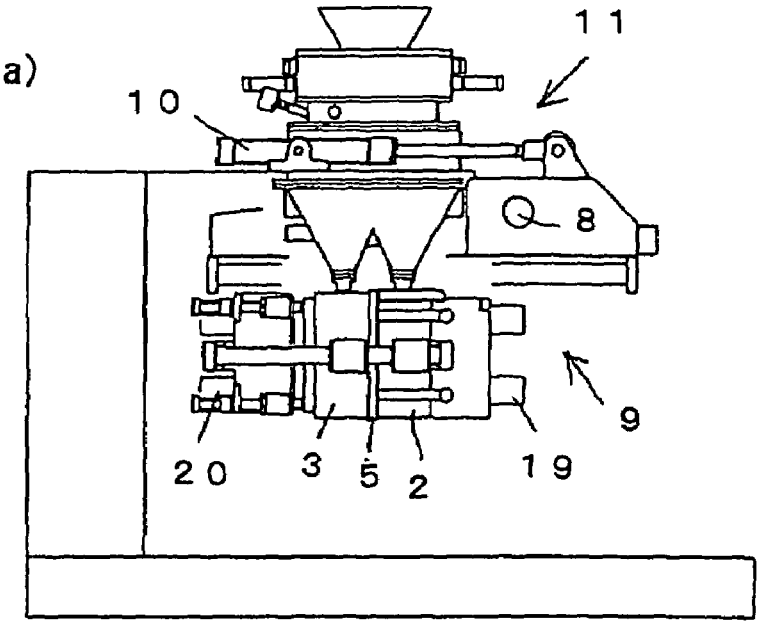
Figure 6:
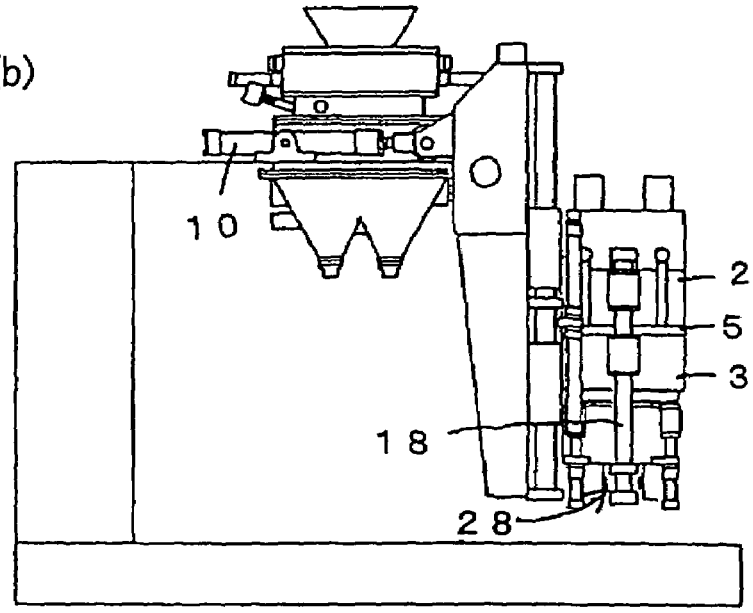

FIGS. 6(*a*) and (*b*) show operational views indicating some of the processes for molding a mold by the apparatus shown in FIG. 1.

Figure 7:
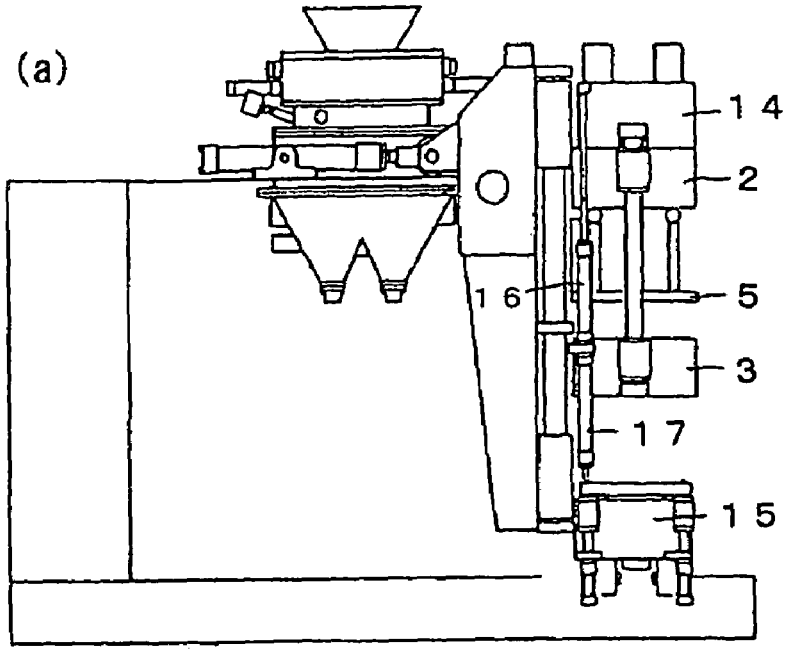
Figure 7:
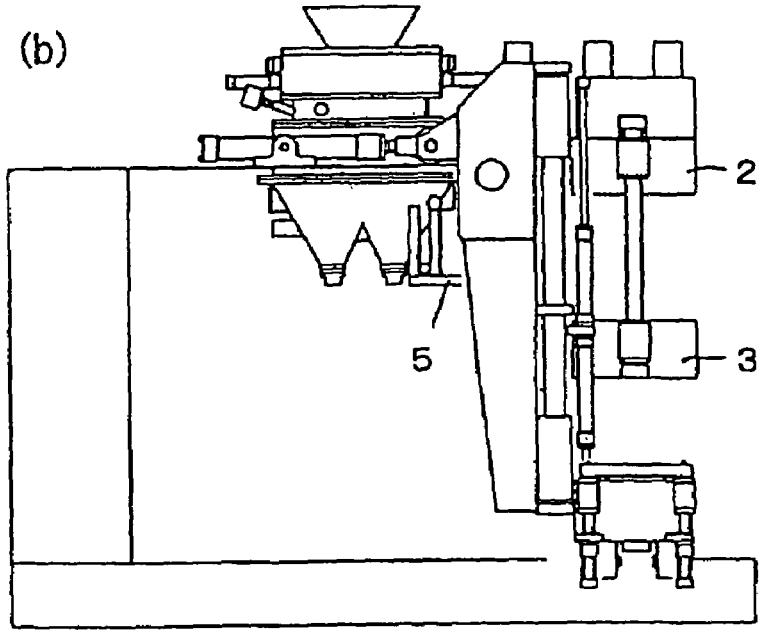

FIGS. 7(*a*) and (*b*) show operational views indicating some of the processes for molding a mold by the apparatus shown in FIG. 1.

Figure 8:
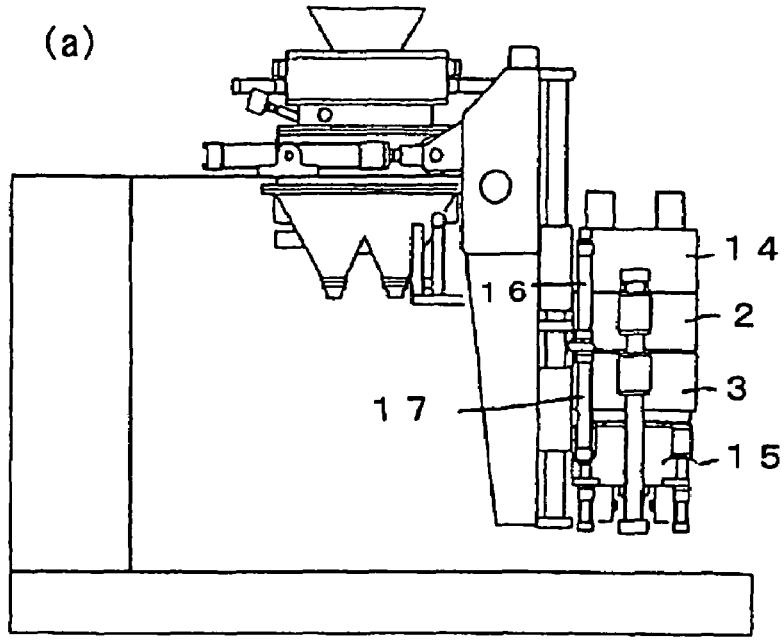
Figure 8:
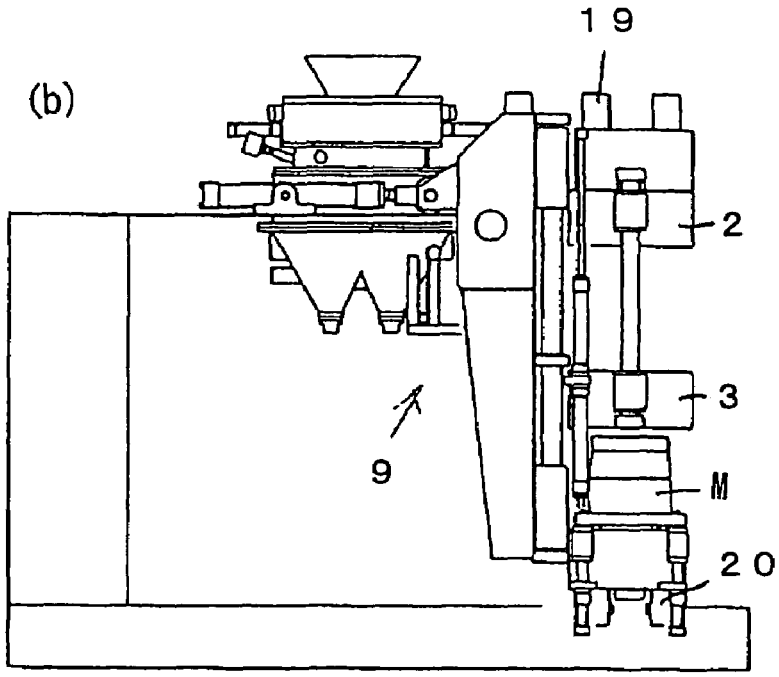

FIGS. 8(*a*) and (*b*) show operational views indicating some of the processes for molding a mold by the apparatus shown in FIG. 1.

Figure 9:
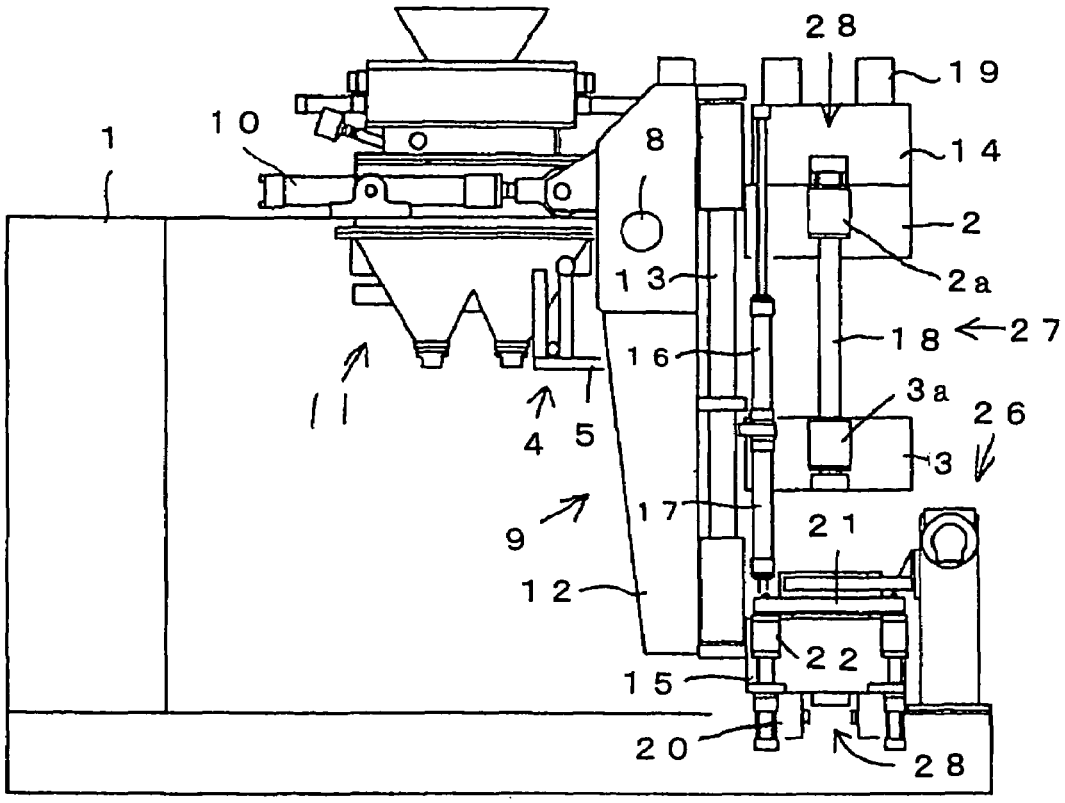

FIG. 9 shows an elevational view of an apparatus for molding a mold of the preferred embodiment of the invention, using segmented-squeeze feet as a squeeze means.

Figure 10:
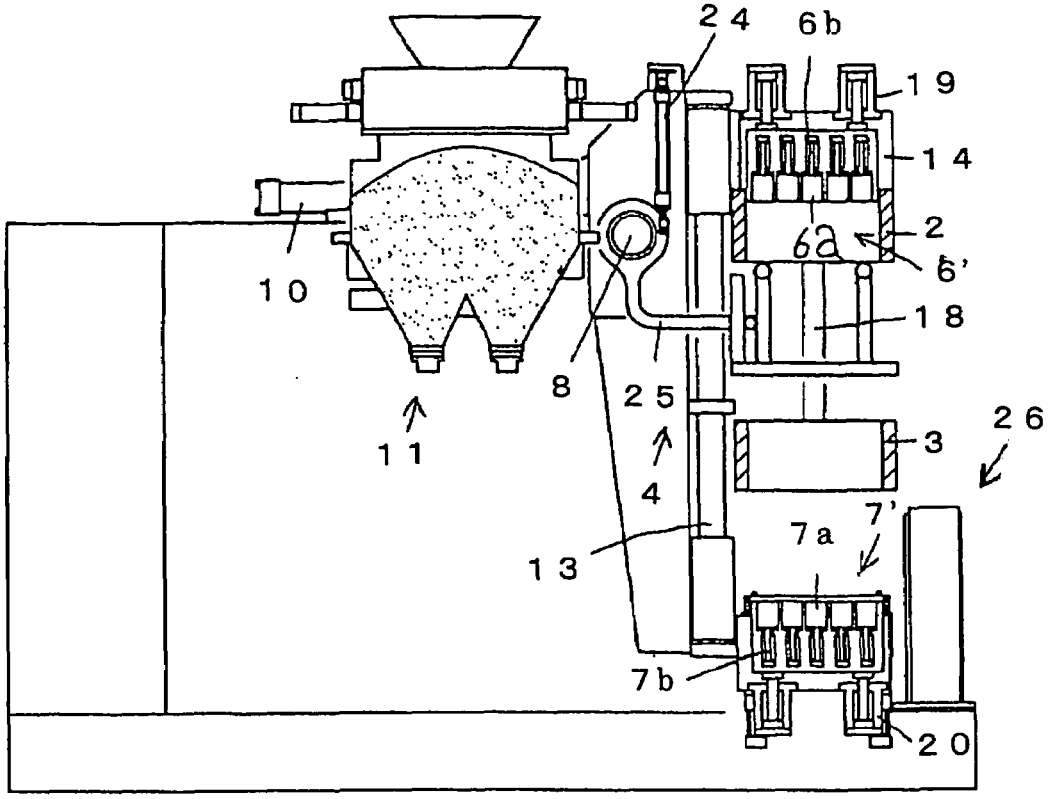

FIG. 10 shows a part of a sectional view of an elevational view of FIG. 9.

Figure 11:
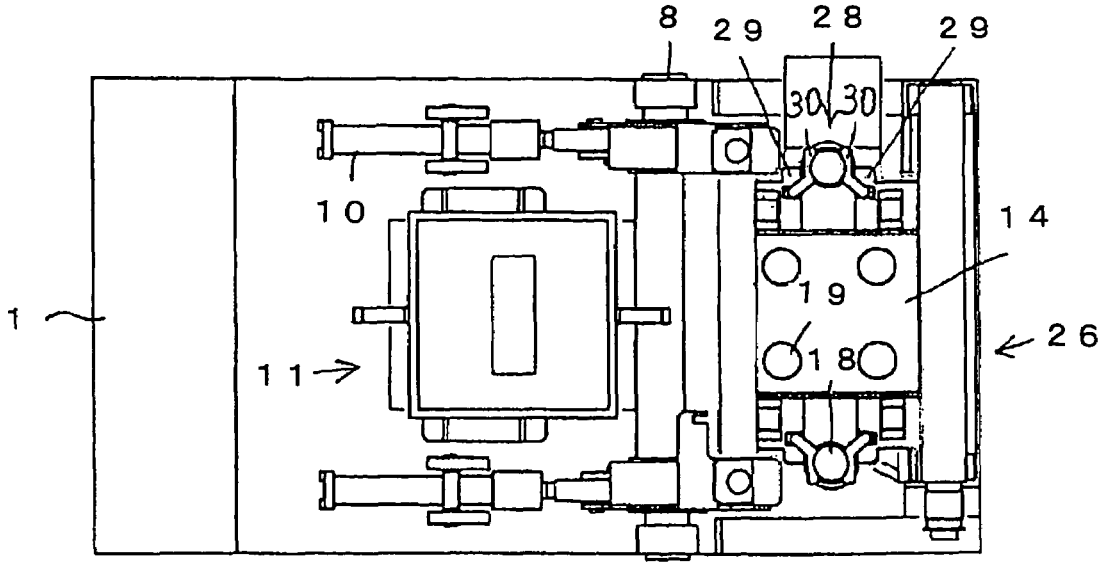

FIG. 11 shows a part of a sectional view of a plane view of FIG. 9.

Figure 12:
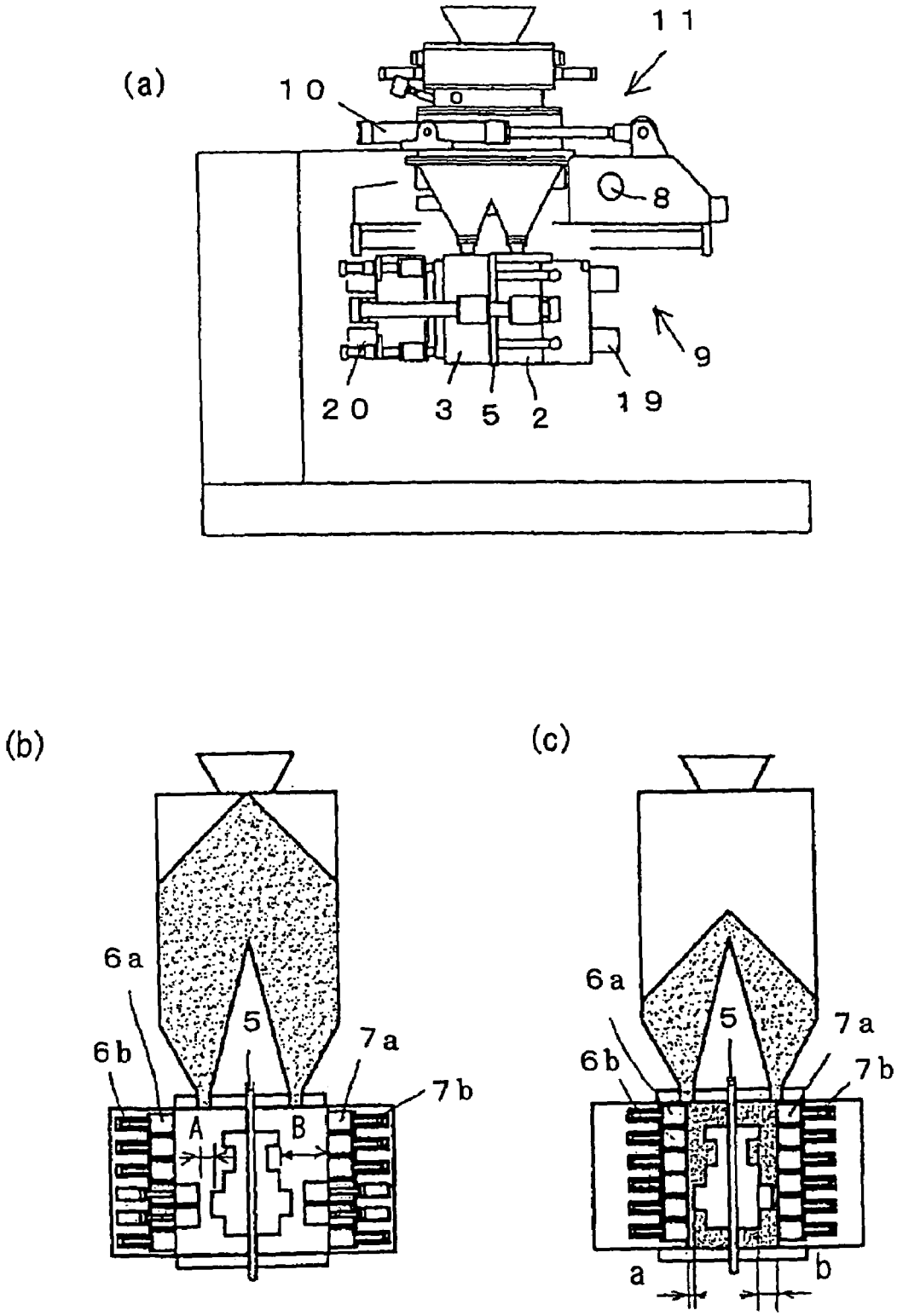

FIGS. 12(*a*), (*b*) and (*c*) show operational views indicating some of the processes for molding a mold by the apparatus shown in FIG. 9.

Figure 13:
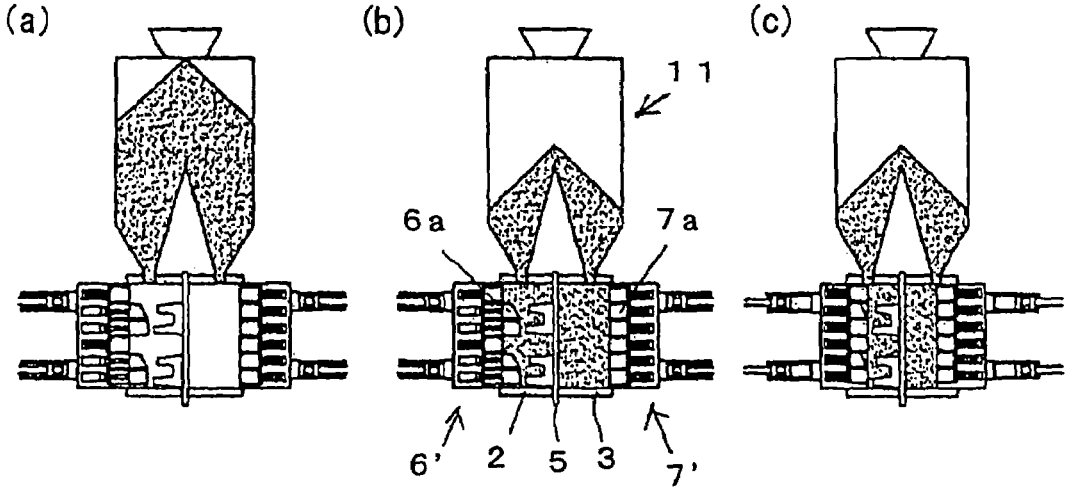

FIGS. 13(*a*), (*b*) and (*c*) show operational views indicating some of the processes for molding a mold by the apparatus shown in FIG. 9.

Figure 14:
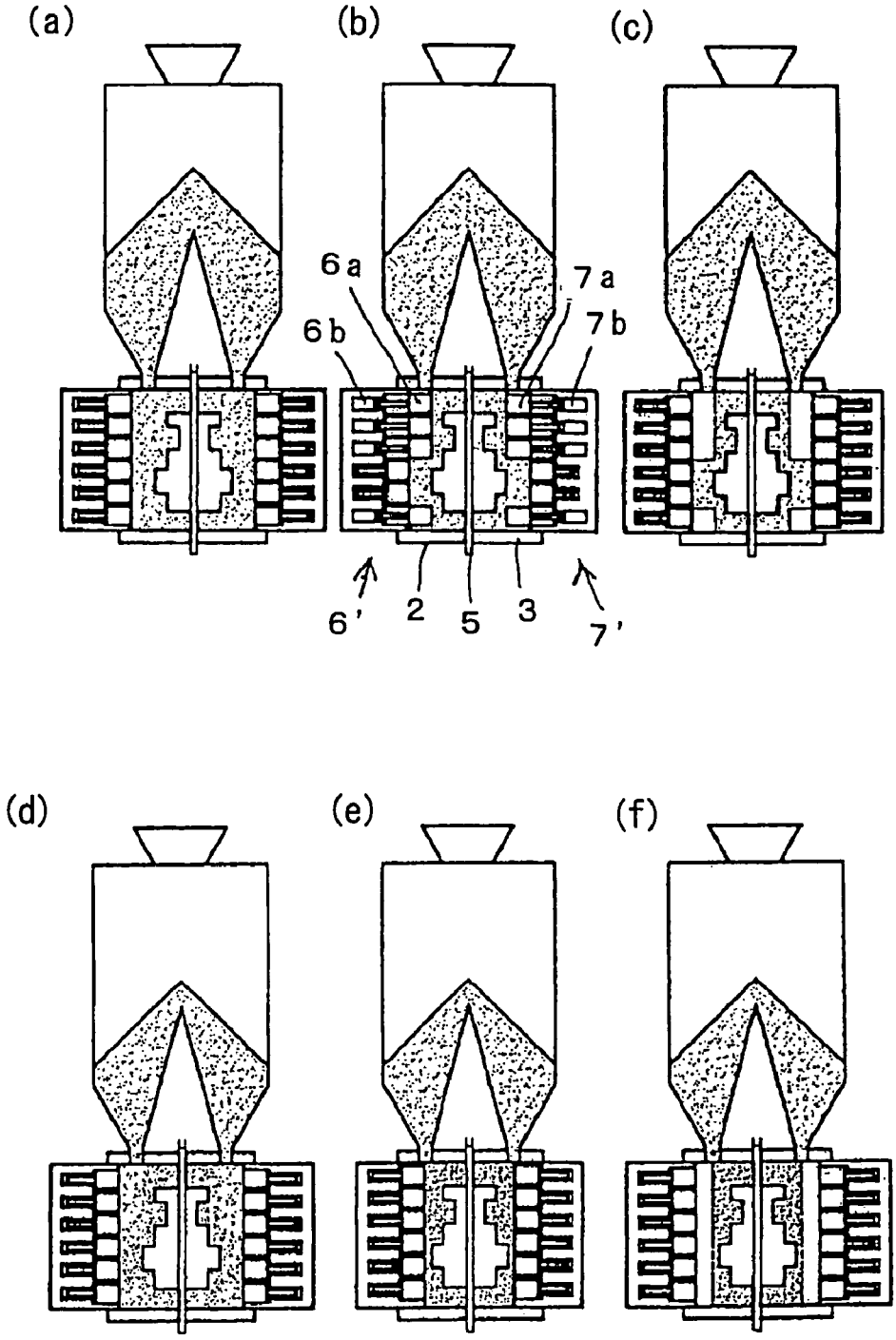

FIGS. 14(*a*)-(*f*) show operational views indicating some of the processes for molding a mold by the apparatus shown in FIG. 9.

PREFERRED EMBODIMENTS OF THE INVENTION

Preferred embodiments of these inventions for an apparatus for molding an upper and a lower mold having no flask are now explained in detail based on FIGS. 1-8.

Figure 2:
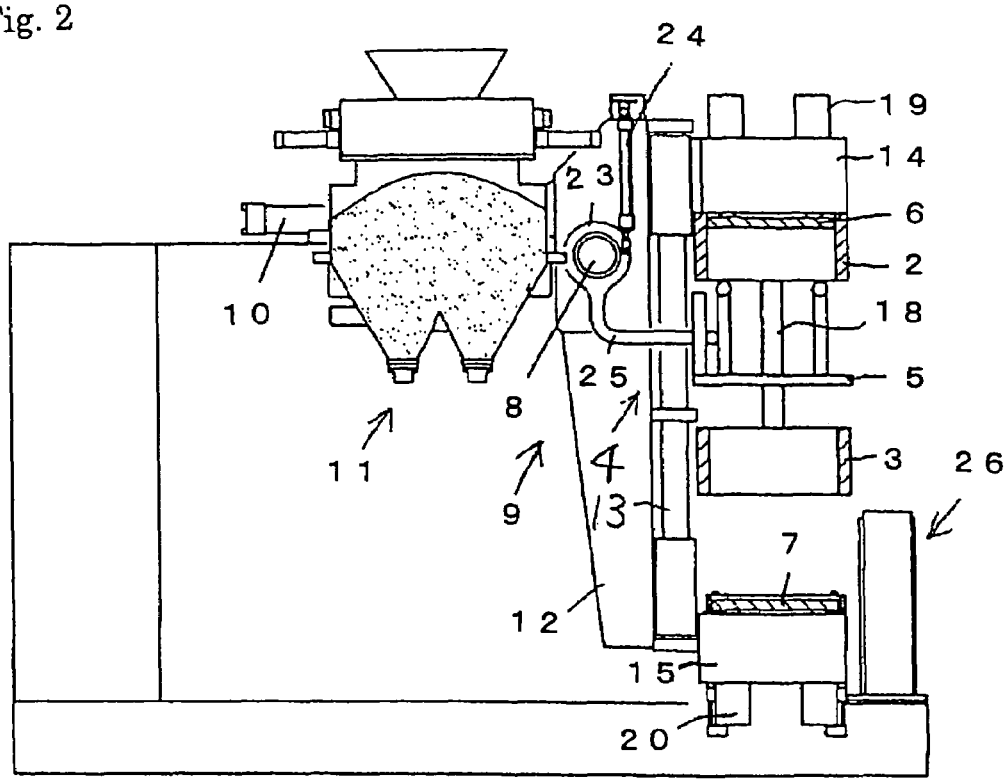
FIG. 2 shows a part of a sectional view of an elevational view of FIG. 1.
Figure 3:
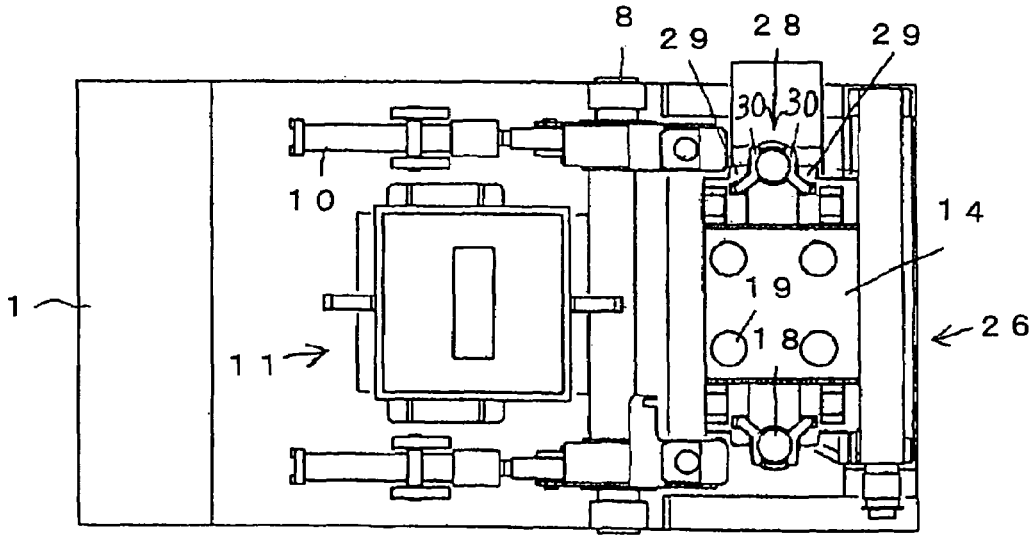
FIG. 3 shows a part of a sectional view of a plane view of FIG. 1.

As shown in FIGS. 1-3, the apparatus for molding the upper and the lower mold having no flask includes:

a base 1 having an internal space, a unit of an upper and a lower flask 27 having intakes disposed at their side walls for foundry sand, wherein the upper flask 2 and the lower flask 3 are connected to each other by a pair of connecting rods 18, 18 so that they can move close to and apart from each other, a match plate 5 disposed between the upper and the lower flask 2, 3 so that the match plate can be inserted and taken out by a conveying apparatus 4, a squeezing mechanism 9 to squeeze the foundry sand, which mechanism 9 supports the unit of the upper and the lower flask 27 having the match plate 5 between the upper and the lower flask 2, 3 by a pair of clamping mechanisms 28, 28 so that the unit of the upper and the lower flask 27 can be removed, which mechanism 9 supports an upper and a lower squeeze plate 6, 7 acts as the squeeze means inserted into openings of the upper and the lower flask having no match plate 5 so that the squeeze means can be taken out, and which mechanism 9 can rotate clockwise or counterclockwise in a perpendicular plane about a supporting shaft 8 disposed on the upper and central portion of the base 1 so that the pair of the upper and the lower flask 2, 3 having the match plate 5 between the upper and the lower flask 2, 3 can be perpendicular or horizontal respectively, two cylinders 10, 10 disposed in the horizontal direction as a driving mechanism to rotate the squeezing mechanism 9 clockwise or counterclockwise, and an aeration mechanism 11 to fill the foundry sand into the upper and the lower flask 2, 3, which are perpendicular, by means of the cylinders 10, 10, through the intakes of the upper and the lower flask.

In the unit of the upper and the lower flask 27, protuberances 2*a*, 3*a* are disposed at the front and the rear outer side of the upper and the lower flask 2, 3. The connecting rods 18, 18 are disposed through the protuberances 2*a*, 3*a* so that the protuberances 2*a*, 3*a* can slide upward and downward. The lower flask 3 is hung from the upper flask by the connecting rods 18, 18 so that the lower flask can move apart from the upper flask to a set distance, as shown in FIG. 1.

Further, grooves, which can engage the clamp means 30 of the clamping mechanisms 28, 28 explained below in detail, are disposed at the upper and the lower portion of the connecting rods 18, 18.

As shown in FIG. 3, the clamping mechanisms 28, 28 are disposed at the front and the rear outer side of the upper lifting and lowering frame 14. The clamping mechanisms 28, 28 include a pair of motors 29, 29 and a pair of the clamp means 30, 30. The clamp means 30, 30 are fixed to the shafts of the motors, which can rotate clockwise or counterclockwise. Thus the clamp means 30, 30 can swing by means of the rotation of the motors 29, 29. Thereby the pair of the clamp means 30, 30 can engage the grooves disposed at the upper portion of the connecting rods 18, 18 of the unit of the upper and the lower flask 27 and can hold the upper portion of the connecting rods.

The clamping mechanisms 28 are also disposed at the front and the rear outer side of the lower lifting and lowering frame 15 and can engage the grooves disposed at the lower portion of the connecting rods 18, 18 and can hold the lower portion of the connecting rods.

In the squeeze mechanism 9, as shown in FIGS. 1 and 2, a central portion of a rotating frame 12 is disposed at the supporting shaft 8 so that the rotating frame 12 can rotate clockwise or counterclockwise in the perpendicular plane.

A pair of guide rods 13, 13 extending upward and downward are disposed at the right side of the rotating frame 12 with a set interval in the direction connecting the front and back sides of the rotating frame 12.

The upper lifting and lowering frame 14, having a reverse L-shaped configuration, is slidably disposed at the upper portion of the guide rods 13, 13 through a holder portion fixed to the lifting and lowering frame 14. Also, the lower lifting and lowering frame 15, having an L-shaped configuration, is slidably disposed at the lower portion of the guide rods 13, 13 through a holder portion fixed to the lifting lowering frame 15.

The upper and the lower lifting and lowering frame 14, 15 can access and separate from each other by driving a cylinder 16 arranged upward and a cylinder 17 arranged downward.

A plurality of the cylinders 19, 19 to move the squeeze plate 6 forward or backward are disposed at the upper lifting and lowering frame 14.

Also, a plurality of the cylinders 20, 20 to move the squeeze plate 7 forward or backward are disposed at the lower lifting and lowering frame 15.

The upper and the lower lifting and lowering frame 14, 15 each have a large and horizontal flat surface so as to push the upper and the lower flask 2, 3.

Further, cylinders 22, 22 arranged upward are disposed at the front and the rear outer side of the lower lifting and lowering frame 15. A leveling frame 21 is disposed around the lower squeeze plate 7 and between the piston rods of a plurality of the cylinders 22, 22 so that the leveling frame 21 can slidably move upward and downward around the lower squeeze plate 7.

The conveying apparatus 4 for carrying the match plate 5 includes:

a ring member 23 disposed on the surface of the supporting shaft 8 of the squeezing mechanism 9, a cylinder 24 connected to the aeration mechanism 11 at its base end and rotatably connected to the portion of the ring member 23 at the distal end of the piston rod of the cylinder 24, a pair of arms 25, 25 fixed to the ring member 23 at its end as a cantilevered structure, and a carriage (not shown) hung so as to be able to hold the match plate 5 and reciprocate from side to side, as shown in FIGS. 1 and 2.

The pair of the arms 25, 25 rotate by the telescopic movement of the cylinder 24. Then the carriage can insert the pattern plate 5 between the pair of the upper and the lower flask 2, 3 on the squeezing mechanism 9, which is horizontal, and can remove the pattern plate 5 from between the pair of the upper and the lower flask.

The aeration mechanism 11 is disposed at the upper-left side portion of the base 1, and is comprised of two aeration tanks (not shown).

The aeration mechanism 11 can fill the foundry sand into the upper and the lower flask independently by means of pressurized air.

An air pressure of 0.05 Mpa-0.18 Mpa is preferable to aerate the foundry sand.

The aeration tanks may be operated at the same time by controlling them simultaneously by two controllers or by controlling them by one controller.

A number 26, shown in the figures, denotes an apparatus for pushing out the upper and the lower mold to the supporting table, which molds are removed from the upper and the lower flask 2, 3, and are positioned on the supporting table.

FIGS. 9-11 show an apparatus using the upper and lower segmented-squeeze feet as the upper and the lower squeeze means for molding the upper and the lower mold having no flask.

The difference between the apparatus using the upper and lower segmented-squeeze feet as the upper and the lower squeeze means and using the upper and lower squeeze plate as the ones for molding the upper and the lower mold having no flask is the use of a plurality of the upper and lower segmented-squeeze feet 6*a*, 6*a*, 7*a*, 7*a* instead of the upper and the lower squeeze plate.

The upper and lower segmented-squeeze feet 6*a*, 6*a*, 7*a*, 7*a* can be inserted into the openings of the upper and the lower flask 2, 3 that have no match plate 5 so that the segmented-squeeze feet can be taken out.

A plurality of cylinders 19, 19 are disposed at the upper lifting and lowering frame 14 to move an upper squeeze plate 6' forward and backward as shown in FIG. 10. A plurality of cylinders 20, 20 are disposed at the lower lifting and lowering frame 15 to move a lower squeeze plate 7' forward and backward.

A plurality of the upper segmented-squeeze feet 6*a*, 6*a* can move forward and backward by driving a plurality of the cylinders 6*b*, 6*b*. A plurality of the lower segmented-squeeze feet 7*a*, 7*a* can move forward and backward by driving a plurality of the cylinders 7*b*, 7*b*.

Further, a leveling frame 21 is disposed around the lower segmented-squeeze feet 7*a*, 7*a* and between the piston rods of a plurality of the cylinders 22, 22 so that the leveling frame 21 can slidably move upward and downward.

The upper and the lower and the upper lifting and lowering frame 14, 15 have large horizontal flat surfaces so as to push the upper and the lower flask 2, 3, which are similar to the apparatus using the upper and the lower squeeze plate, as the upper and the lower squeeze means for molding the upper and the lower mold having no flask.

Explained above is the difference between the apparatus using the upper and lower segmented-squeeze feet as the upper and the lower squeeze means and using the upper and the lower squeeze plate as the ones for molding the upper and the lower mold having no flask.

These two apparatuses are comprised of the same elements, except for the different elements explained above.

The processes for molding the upper and the lower mold having no flask by the apparatus, shown in FIG. 1, using the squeeze plates as the squeeze means are now explained in detail.

First, as shown in FIG. 4-*a*, the match plate 5 is inserted between a unit of the upper and the lower flask 2, 3, which are horizontal, by driving the cylinder 24 of the conveying apparatus 4 so that a pair of the arms 25, 25 can rotate. Next, while the upper flask 2 is being slightly moved up and down by driving the cylinder 16, the pair of the arms 25, 25 are released from the carriage by driving the cylinder 24 of the conveying apparatus 4 so that the pair of the arms 25, 25 can rotate clockwise and are returned to the initial position.

Then, as shown in FIG. 4-*b*, the upper and the lower flask 2, 3 approach each other by means of driving the cylinder 16, which is arranged upward, and the cylinder 17, which is arranged downward, of the squeezing mechanism 9, so that the upper and the lower lifting and lowering frame 14, 15 can approach each other. Next, as shown in FIG. 5-*a*, a pair of the clamping mechanisms 28, 28 disposed at the lower lifting and lowering frame 15 hold the lower portion of the connecting rods of the unit of the upper and lower flask 27.

Then, as shown in FIG. 5-*b*, the upper squeeze plate 6 and the lower squeeze plate 7 are inserted in the upper and the lower flask 2, 3 at a predetermined depth to define the upper and the lower molding space by driving a plurality of the cylinders 19, 19, 20, 20 of the squeezing mechanism 9.

Next, as shown in FIG. 6-*a*, the upper and the lower flask 2, 3 and the match plate 5 become perpendicular by driving the cylinder 10 so that the squeezing mechanism 9 rotates clockwise about the supporting shaft 8.

The intakes for foundry sand are moved upward and caused to contact the lower ends of the two aeration tanks of the aeration mechanism 11.

In this case, while the upper and the lower molding space are being defined, the squeezing mechanism 9 may be rotated clockwise about the supporting shaft 8 by driving the cylinder 10.

Further, after the upper and the lower molding space are defined, the squeezing mechanism 9 may be rotated clockwise about the supporting shaft 8 by driving the cylinder 10.

Then, the upper and the lower molding space are filled with the foundry sand by discharging it from the aeration mechanism 11 through the intakes.

The foundry sand in the upper and in the lower molding space is squeezed by moving the upper and the lower squeeze plate 6, 7 forward by means of driving a plurality of the cylinders 19, 19, 20, 20.

When the foundry sand in the upper and in the lower molding space is squeezed, the forces of the cylinders 19, 19, 20, 20 that react to drive the upper and the lower lifting and lowering frame 14, 15 are supported by the upper and the lower clamping mechanism 28, 28 and the connecting rods 18, 18.

Next, as shown in FIG. 6-*b*, the upper and the lower flask 2, 3 and the match plate 5 are rotated so that they are horizontal.

In this case, the process for squeezing the foundry sand and the process for rotating the upper and the lower flask and the match plate so that they are horizontal may be carried out simultaneously. Otherwise, either of them may be carried out before the other.

The process to fill the foundry sand and the squeezing process may be carried out by the following two-stage process. Namely, the upper and the lower molding space are filled with the foundry sand by discharging it from the aeration mechanism 11 through the intakes, and then the upper and the lower squeeze plate 6, 7 are moved backward to retract the squeeze plates 6, 7 to a position near the opening of a pair of the upper and the lower flask by driving a plurality of the cylinders 19, 19, 20, 20.

Next, the upper and the lower molding space are also filled with the foundry sand by discharging it from the aeration mechanism 11 through the intakes, and while the upper and the lower flask 2, 3 and the match plate 5 are rotated so that they are horizontal, the foundry sand in the upper and the lower molding space is squeezed by driving a plurality of the cylinders 19, 19, 20, 20 so that the upper and the lower squeeze plate 6, 7 move forward.

In the process for filling and squeezing the foundry sand, the upper and lower squeeze plates 6, 7 are moved backward to retract the squeeze plates 6, 7 to a position near the opening of the pair of the upper and the lower flask, after the upper and the lower molding space defined by inserting the upper and lower squeeze plates 6, 7 in the upper and the lower flask 2, 3 are filled with the foundry sand.

However, while the upper and the lower molding space defined by inserting the upper and lower squeeze plates 6, 7 in the upper and the lower flask 2, 3 are being filled with the foundry sand, the upper and the lower squeeze plate 6, 7 may move backward to retract the squeeze plates 6, 7 to a position near the opening of the pair of the upper and the lower flask.

As mentioned above, by using the two-stage process for filling and squeezing the foundry sand, it is possible to increase the hardness of the foundry sand near the opening of the upper and lower flasks 2, 3.

Next, the lower clamping mechanisms 28, 28 are released from the connecting rods 18, 18. As shown in FIG. 7-*a*, the upper flask 2 is lifted up, and the lower flask 3 is lowered by the upper and the lower lifting and lowering frame 14, 15 by a means that drives the cylinder 16, which is arranged upward, and the cylinder 17, which is arranged downward. Consequently, the upper and the lower flask 2, 3, containing the mold molded by squeezing the foundry sand, are separated from the match plate 5. Then, the lower flask 3 is hung by the connecting rods 18, 18.

Next, as shown in FIG. 7-*b*, the match plate 5 is carried out by driving the cylinder 24 so that the arms 25, 25 are rotated. As shown in FIG. 8-*a*, if necessary, after the core is set, the upper flask 2 is lowered, and the lower flask 3 is lifted up by the upper and the lower lifting and lowering frame 14, 15 by a means that drives the cylinder 16, which is arranged upward, and the cylinder 17, which is arranged downward. Consequently, the upper and the lower flask 2, 3, containing the mold, are matched to each other.

Then, as shown in FIG. 8-*b*, the upper and lower squeeze plates 6, 7 are lowered by driving a plurality of the cylinders 19, 19 of the squeezing mechanism 9 and a plurality of the cylinders 20, 20 of the squeezing mechanism 9. Simultaneously, the upper flask 2 is lifted up, and the lower flask is lowered by a means that drives the cylinder 16, which is arranged upward, and the cylinder 17, which is arranged downward. Then, the lower flask 3 is hung by the connecting rods 18, 18. Consequently, the upper and the lower mold "M" are removed from the upper and the lower flask. The upper and the lower mold "M" are pushed out from the squeeze plate 7 by the apparatus 26 for pushing out the molds.

The processes for molding the upper and the lower mold having no flask by the apparatus using the segmented-squeeze feet as the squeeze means are now explained in detail based on FIG. 9.

First, the match plate 5 is inserted between a unit of the upper and the lower flask 2, 3, which are horizontal, by driving the cylinder 24 of the conveying apparatus 4 so that a pair of the arms 25, 25 can rotate. Next, while the upper flask 2 is being moved slightly up and down by driving the cylinder 16, the pair of the arms 25, 25 are released from the carriage by driving the cylinder 24 of the conveying apparatus 4 so that the pair of the arms 25, 25 can rotate clockwise and are returned to the initial position.

Then, the upper and the lower flask 2, 3 approach each other by means of driving the cylinder 16, which is arranged upward, and the cylinder 17, which is arranged downward, of the squeezing mechanism 9, so that the upper and the lower lifting and lowering frame 14, 15 can approach each other. Next, a pair of the clamping mechanisms 28, 28 disposed at the lower lifting and lowering frame 15 hold the lower portion of the connecting rods 18, 18 of the unit of the upper and the lower flask 27.

Next, the upper and the lower flask 2, 3 and the match plate 5 become perpendicular by driving the cylinder 10 so that the squeezing mechanism 9 rotates clockwise about the supporting shaft 8. The intakes of the upper and the lower flask 2, 3 for foundry sand are moved upward and caused to contact the lower ends of the two aeration tanks of the aeration mechanism 11. (See FIG. 12-*a*.)

Next, while the squeezing mechanism 9 is rotating clockwise, a plurality of the upper and lower segmented-squeeze feet 6*a*, 6*a*, 7*a*, 7*a* of the upper and the lower squeeze means 6', 7' are inserted in the upper and the lower flask at a predetermined depth to define the upper and the lower molding space by driving a plurality of the cylinders 19, 19, 20, 20 of the squeezing mechanism 9.

In this case, while the upper and the lower molding space are being defined, the squeezing mechanism 9 may be rotated clockwise about the supporting shaft 8 by driving the cylinder 10.

Further, after the upper and the lower molding space are defined, the squeezing mechanism 9 may be rotated clockwise about the supporting shaft 8 by driving the cylinder 10.

A plurality of the upper and lower segmented-squeeze feet 6*a*, 6*a*, 7*a*, 7*a* of the upper and the lower squeeze means 6', 7' are moved for a predetermined distance so that each of the respective ratios of the distance between each of the upper and lower segmented-squeeze feet 6*a*, 6*a*, 7*a*, 7*a* and the match plate 5 before squeezing the foundry sand to that after squeezing becomes almost the same.

When, as shown in FIG. 12(*b*), the distances between a plurality of the upper and lower segmented-squeeze feet 6*a*, 6*a*, 7*a*, 7*a* and the corresponding portion of the match plate 5 before squeezing the foundry sand are defined as "A" and "B," and, as shown in FIG. 12(*c*), those after squeezing are defined as "a" and "b," the segmented-squeeze feet 6*a*, 6*a*, 7*a*, 7*a* are moved so that the ratios of "a/A" and "b/B" can have the relation close to "a/A=b/B."

Namely, when the height of the portion of the match plate is high, the upper and lower segmented-squeeze feet 6*a*, 6*a*, 7*a*, 7*a* are moved so that the quantity of the foundry sand at the position corresponding to the portion becomes less, and when the height of the portion of the match plate is low, they are not moved too much, so that the quantity of the foundry sand at the position corresponding to the portion becomes greater.

Then, the upper and the lower molding space are filled with the foundry sand by discharging it from the aeration mechanism 11 through the intakes of the upper and the lower flask 2, 3.

The foundry sand in the upper and lower molding space is squeezed by driving a plurality of the cylinders 19, 19, 20, 20, so that a plurality of the upper and lower segmented-squeeze feet 6*a*, 6*a*, 7*a*, 7*a* can move forward.

Next, after a plurality of the upper and lower segmented-squeeze feet 6*a*, 6*a*, 7*a*, 7*a* are retracted by driving a plurality of the cylinders 6*b*, 6*b*, 7*b*, 7*b*, the segmented-squeeze feet 6*a*, 6*a*, 7*a*, 7*a* are moved further forward by driving the cylinders 19, 19, 20, 20.

By these processes, the density of the foundry sand of the upper and the lower mold can become uniform, and the surfaces opposed to the upper and lower segmented-squeeze feet 6*a*, 6*a*, 7*a*, 7*a* of the foundry sand in the flasks 2, 3 can become flat. (See FIG. 12-*c*.)

When the foundry sand in the upper and the lower molding space is squeezed, the forces of the cylinders 19, 19, 20, 20 that react to drive the upper and the lower lifting and lowering frame 14, 15 are supported by the upper and the lower clamping mechanism 28, 28 and the connecting rods 18, 18.

Next, while the upper and the lower flask 2, 3 and the match plate 5 are rotating so that they become horizontal, the lower clamping mechanisms 28, 28 are released from the connecting rods 18, 18. The upper flask 2 is lifted up, and the lower flask 3 is lowered, by the upper and the lower lifting and lowering frame 14, 15, by a means that drive the cylinder 16, which is arranged upward, and the cylinder 17, which is arranged downward. Consequently, the upper and the lower flask 2, 3, containing the mold molded by squeezing the foundry sand, are separated from the match plate 5. Then, the lower flask 3 is hung by the connecting rods 18, 18.

Next, the match plate 5 is carried out by driving the cylinder 24 so that the arms 25, 25 are rotated. If necessary, after the core is set, the upper flask 2 is lowered, and the lower flask 3 is lifted up by the upper and the lower lifting and lowering frame 14, 15 by a means that drives the cylinder 16, which is arranged upward, and the cylinder 17, which is arranged downward. Consequently, the upper and the lower flask 2, 3, containing the mold, are matched to each other.

Then, the upper and lower segmented-squeeze feet 6*a*, 6*a*, 7*a*, 7*a* are lowered by driving a plurality of the cylinders 19, 19 of the squeezing mechanism 9 and a plurality of the cylinders 20, 20 of the squeezing mechanism 9. Simultaneously, the upper flask 2 is lifted up, and the lower flask is lowered, by a means that drives the cylinder 16, which is arranged upward, and the cylinder 17, which is arranged downward. Then, the lower flask 3 is hung by the connecting rods 18, 18. Consequently, the upper and the lower mold "M" are removed from the upper and the lower flask. The upper and the lower mold "M" are pushed out from the segmented-squeeze feet 7*a*, 7*a* by the apparatus 26 for pushing out the molds.

In this preferred embodiment, when the distances between a plurality of the upper and lower segmented-squeeze feet 6*a*, 6*a*, 7*a*, 7*a* and the corresponding portion of the match plate 5 before squeezing the foundry sand are defined as "A" and "B," and those after squeezing are defined as "a" and "b," the segmented-squeeze feet 6*a*, 6*a*, 7*a*, 7*a* are moved so that the ratios of "a/A" and "b/B" can have the relation of close to "a/A=b/B," to thereby make the density of the foundry sand of the upper and the lower mold become uniform, and to make the surface of the foundry sand in the flasks 2, 3 opposed to the upper and lower segmented-squeeze feet 6*a*, 6*a*, 7*a*, 7*a* also become flat.

However, the method for molding the molds is not limited to this process.

For example, as shown in FIGS. 13(*a*)-13(*c*), after the space between the match plate 5 and a plurality of the upper and lower segmented-squeeze feet 6*a*, 6*a*, 7*a*, 7*a* opposed to the match plate 5 is formed so that the foundry sand can easily flow in the space, the molds may be molded by discharging the foundry sand into the molding space through the intakes of the upper and the lower flask 2, 3.

It is possible to reduce the friction between the foundry sand and a wall of an aeration tank by jetting air into a nozzle (especially, a nozzle throat) of the aeration tank and a portion where it is difficult for the foundry sand to flow to make the foundry sand easily flow in the space between a plurality of the upper and lower segmented-squeeze feet 6*a*, 6*a*, 7*a*, 7*a* and the match plate 5.

As shown in FIGS. 14(*a*)-14(*b*), the following process may also be acceptable.

Namely, after the upper and the lower molding space, which are perpendicular, are defined by the match plate 5, by the upper and the lower flask 2, 3, and by a plurality of the upper and lower segmented-squeeze feet 6*a*, 6*a*, 7*a*, 7*a*, acting as the upper and the lower squeeze means 6', 7', then the foundry sand is filled into the upper and the lower molding space through the intakes of the upper and the lower flask 2, 3.

Then the foundry sand in the molding space is squeezed by driving a plurality of the cylinders 6*b*, 6*b*, 7*b*, 7*b* so that a plurality of the segmented-squeeze feet 6*a*, 6*a*, 7*a*, 7*a* can move forward.

Next, after a plurality of the upper and lower segmented-squeeze feet 6*a*, 6*a*, 7*a*, 7*a* are retracted by driving a plurality of the cylinders 6*b*, 6*b*, 7*b*, 7*b*, the foundry sand is further filled into the upper and the lower molding space through the intakes.

Then, the squeezing surfaces of a plurality of the upper and lower segmented-squeeze feet 6*a*, 6*a*, 7*a*, 7*a* are arranged in a flat plane, and the foundry sand in the upper and the lower molding space is further squeezed by driving a plurality of the cylinders 19, 19, 20, 20 so that a plurality of the upper and lower segmented-squeeze feet 6*a*, 6*a*, 7*a*, 7*a* can move forward together.

Further, a plurality of the upper and lower segmented-squeeze feet 6*a*, 6*a*, 7*a*, 7*a*, integrated with some of a plurality of the upper and lower segmented-squeeze feet 6*a*, 6*a*, 7*a*, 7*a*, can be used.

What we claim is:

1. A method for molding an upper and a lower mold having no flask and that match each other, comprising:

(1) a putting and holding process to put a match plate having a pattern in between an upper and a lower flask having intakes for foundry sand and being horizontal and to hold the match plate, (2) a defining process to define an upper and a lower molding space by inserting an upper and a lower squeeze means into openings of a pair of the upper and the lower flask having no match plate, (3) a rotating and moving process to rotate the pair of the upper and the lower flask and the match plate together with the upper and the lower squeeze means and cylinders to move the upper and the lower squeeze means so that they are perpendicularly positioned, and to move them so that the intakes of the upper and the lower flask move upward, (4) a filling process to fill the upper and the lower molding space with the foundry sand through the intakes of the upper and the lower flask, (5) a squeezing process to squeeze the foundry sand in the upper and the lower molding space by causing the upper and the lower squeeze means to further approach each other, (6) a rotating process to rotate the pair of the upper and the lower flask and the match plate together with the upper and the lower squeeze means and cylinders to move the upper and the lower squeeze means so that they are again horizontally positioned, (7) a removing process to remove the match plate disposed between the upper and the lower flask after separating the upper and the lower flask containing, respectively, an upper and a lower mold from the match plate, (8) a matching process to match the upper and the lower flask containing the upper and the lower mold to each other, and (9) a removing process to remove the molds from the pair of the upper and the lower flask that are caused to match each other.

2. The method of claim 1, wherein, the defining process (2) and the rotating and moving process (3) are carried out simultaneously.

3. The method of claim 1, wherein the squeezing process (5) and the rotating process (6) are carried out simultaneously.

4. The method of claim 1, wherein an upper and lower squeeze plate are provided as the upper and the lower squeeze means.

5. The method of claim 1, wherein upper and lower segmented-squeeze feet are provided as the upper and the lower squeeze means.

6. The method of claim 4, wherein after the filling process to fill the upper and the lower molding space with the foundry sand through the intakes of the upper and the lower flask is completed, the method further includes:

a) a process to move further apart the upper squeeze plate from the lower squeeze plate to a predetermined distance, and b) a further filling process to further fill the upper and the lower molding space with additional foundry sand through the intakes of the upper and the lower flask.

7. The method of claim 6, wherein, the process to move further apart the upper squeeze plate from the lower squeeze plate to a predetermined distance, and the further filling process to further fill the upper and the lower molding space with the additional foundry sand through the intakes of the upper and the lower flask are carried out simultaneously.

8. The method of claim 5, wherein the defining process (2) further includes a setting process to set the distance between the pattern of the match plate and each of a plurality of the upper and lower segmented-squeeze feet so that each ratio of the distance after squeezing and that before squeezing becomes the same.

9. The method of claim 5, wherein the defining process (2) further includes a forming process to form the molding space defined by the pattern of the match plate and each of a plurality of the upper and lower segmented-squeeze feet so that the foundry sand can easily flow in the molding space.

10. The method of claim 5, wherein the filling process (4) and the squeezing process (5) further include:

a) a first filling process to fill the upper and the lower molding space defined by the upper and the lower flask, the upper and the lower squeeze means, and the match plate, which are perpendicular, with the foundry sand through the intakes of the upper and the lower flask, b) a first squeezing process to squeeze the foundry sand in the upper and the lower molding space by causing a plurality of the upper and lower segmented-squeeze feet of the upper and the lower squeeze means to further approach each other, c) a second filling process to fill the upper and the lower molding space with the additional foundry sand through the intakes of the upper and lower flask after a retracting process is completed to retract the upper and lower segmented-squeeze feet, and d) a second squeezing process to squeeze the foundry sand in the upper and the lower molding space by simultaneously causing the upper and lower segmented-squeeze feet, whose surfaces are arranged in a plane, to further approach each other.

11. An apparatus for molding an upper and a lower mold that match each other and that has no flask, comprising:

(1) a unit of an upper and a lower flask each having intakes disposed at their side walls for foundry sand, which flasks are connected to each other by connecting rods so that they can move close to and away from each other, wherein the connecting rods are disposed through protuberances that are disposed at an outer side of both the upper and the lower flask, (2) a match plate having a pattern disposed between the upper and the lower flask so that the match plate can be inserted in and taken out by a conveying apparatus, (3) a squeezing mechanism to squeeze the foundry sand, including:

a rotating frame, which can rotate clockwise or counterclockwise in the perpendicular plane by a supporting shaft disposed at a base, a pair of guide rods extending upward and downward and disposed at the rotating frame with a set interval, an upper and a lower lifting and lowering frame slidably disposed at the upper and tower portions of the pair of the guide rods, a cylinder arranged upward and a cylinder arranged downward for moving the upper and the lower lifting and lowering frame so that the upper and the lower lifting and lowering frame can approach and separate from each other, which cylinders are disposed at the rotating frame, and an upper and a lower pair of clamping mechanisms disposed at the upper and the lower lifting and lowering frame for clamping and releasing the upper and the lower portion of the connecting rods, wherein the upper and the lower lifting and lowering frame have a plurality of cylinders to move an upper and a lower squeeze means forward or backward, which means are disposed in the upper and the lower flask, (4) a driving mechanism to rotate the squeezing mechanism clockwise or counterclockwise, and (5) an aeration mechanism to fill the foundry sand into the upper and the lower flask, when both are perpendicular, by means of the driving mechanism, through the intake, while the lower pair of clamping mechanisms clamps the lower portion of the connecting rods.

12. The apparatus of claim 11, wherein an upper and a lower squeeze plate are provided as the upper and the lower squeeze means.

13. The apparatus of claim 11, wherein upper and lower segmented squeeze feet are provided as the upper and the lower squeeze means.

14. The apparatus of any one of claims 11, 12 and 13, wherein the upper and lower pair of clamping mechanisms to clamp the connecting rods for holding the unit of the upper and the lower flask include a pair of motors, and a pair of clamp means fixed to shafts of the motors, wherein the pair of the clamp means can engage grooves disposed at the upper portion of the connecting rods, and wherein the pair of the clamp means can swing by means of the rotation of the motors.

* * * * *